US005452187A

United States Patent [19]

Belfer et al.

[11] Patent Number: 5,452,187

[45] Date of Patent: Sep. 19, 1995

[54] FLUORESCENT LIGHTING FIXTURE HAVING A BENDABLE SUPPORT AND MOUNTING SYSTEM

[75] Inventors: Bruce D. Belfer; Norman Armbrust, both of Ocean, N.J.

[73] Assignee: Lighting World Inc., Ocean, N.J.

[21] Appl. No.: 238,596

[22] Filed: May 5, 1994

[51] Int. Cl.[6] ..... F21S 3/00

[52] U.S. Cl. ..... 362/221; 362/250

[58] Field of Search ..... 362/216, 219, 225, 221, 362/223, 224, 238, 239, 240, 250

[56] References Cited

U.S. PATENT DOCUMENTS 4,439,818 3/1984 Scheib ..... 362/221

5,221,139 6/1993 Belfer ..... 362/216

*Primary Examiner*—Carroll B. Dority

*Attorney, Agent, or Firm*—Ezra Sutton

[57] ABSTRACT

A bendable lighting fixture for fluorescent lighting is provided, which includes a continuous support member formed of curvable material and having a mounting surface for receiving a plurality of ballast housings; a socket for receiving a fluorescent lamp mounted on each of the ballast housings; and the continuous support member being curvable and bendable to form the lighting fixture into the desired curved shape.

5 Claims, 3 Drawing Sheets

FLUORESCENT LIGHTING FIXTURE HAVING A BENDABLE SUPPORT AND MOUNTING SYSTEM

FIELD OF THE INVENTION

The present invention relates to a fluorescent lighting fixture that provides a continuous linear, curved, or circular lighting track. The lighting track has a bendable support and mounting system to provide a custom design for any installation.

BACKGROUND OF THE INVENTION

In present lighting fixtures, the fluorescent lamps are usually arranged in a straight line and positioned such that the lighting fixtures are all at the same level. These lighting fixtures cannot normally be shaped to meet special design configurations, curved contours, or custom fit designs and installations.

It is an object of the present invention to provide a fluorescent lighting fixture that can meet all design configurations of any curved, circular, or radial arc shape in any installation, such as a ceiling, contoured cone, or valance.

Another object of the present invention is to provide a fluorescent lighting fixture that can be custom designed in the field, to the desired shape, without the need of specialized tools.

Another object of the present invention is to provide a bendable or adjustable fluorescent lighting fixture that eliminates the need for exact field dimensions and/or engineering design drawings.

A still further object of the present invention is to provide a fluorescent lighting fixture that can be easily packaged and shipped, which minimizes cost, and delivery and scheduling problems.

Still another object of the present invention is to provide a fluorescent lighting fixture with a flexible and bendable mounting track that can be made of aluminum, stainless steel, and/or plastic materials.

SUMMARY OF THE INVENTION

In accordance with the principles of the present invention, there is provided a fluorescent lighting fixture having a flexible or bendable support and mounting system. The lighting fixture track includes a continuous support and mounting member having a mounting surface on which a plurality of ballast housings and lamp sockets are mounted for supporting the fluorescent lamps. The mounting member is preferably formed from a thin aluminum channel that is easily curvable or bendable. This provides the fluorescent lighting fixture with a flexible or bendable mounting and support system for shaping of the lighting track to any desired curved, semi-curved, radial, or circular configuration, in meeting job site specifications for specialized lighting placements.

BRIEF DESCRIPTION OF THE DRAWINGS

Further objects, features, and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT

Figure 1:
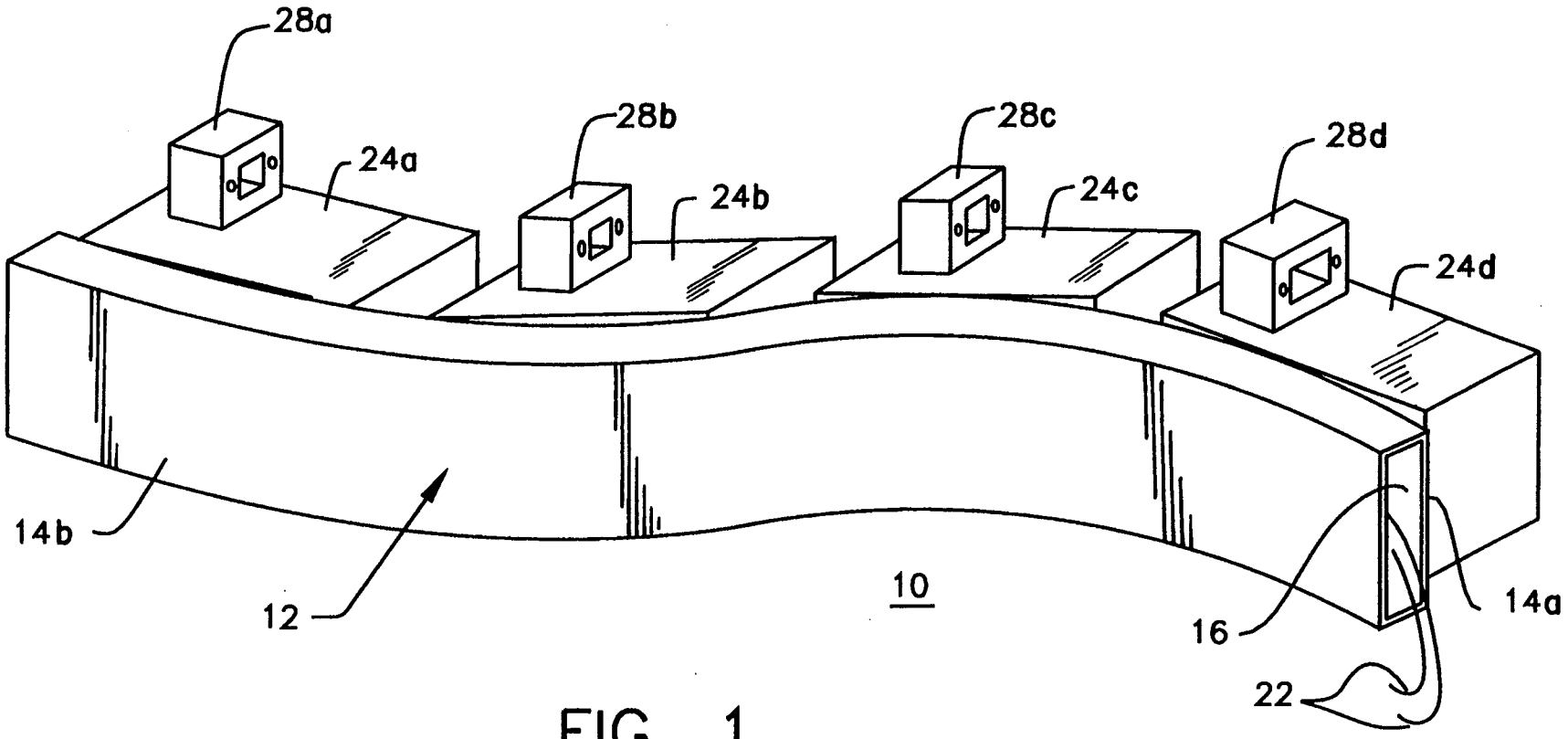
FIG. 1 is a perspective view of the adjustable support and mounting system of the fluorescent lighting fixture of the present invention.

As shown in detail in FIGS. 1, 2, 3A, and 3B of the present invention, the fluorescent lighting fixture 10 includes a continuous support and mounting member 12 having continuous mounting surfaces 14*a* or 14*b*. The continuous support member 12 is a curvable, hollow rectangular channel having a passageway 16 formed through the channel. There are a plurality of holes 18*a* to 18*d* formed in mounting surface 14*a* for receiving electrical wires 22. Mounting surface 14*a* of support member 12 also has a pair of fastening holes 20*a* and 20*b* for mounting each ballast housing 24. The support member 12 may be made of any suitable flexible materials, such as aluminum, stainless steel, or a pliable plastic material.

A plurality of spaced-apart, ballast housings 24 are mounted on mounting surface 14*a* of support member 12 by way of two screw fasteners 26*a* and 26*b* in fastening holes 20*a* and 20*b*. The electrical wires 22 are connected to each ballast housing 24*a* to 24*d* by way of holes 18*a* to 18*d* and passageway 16.

Figure 2:
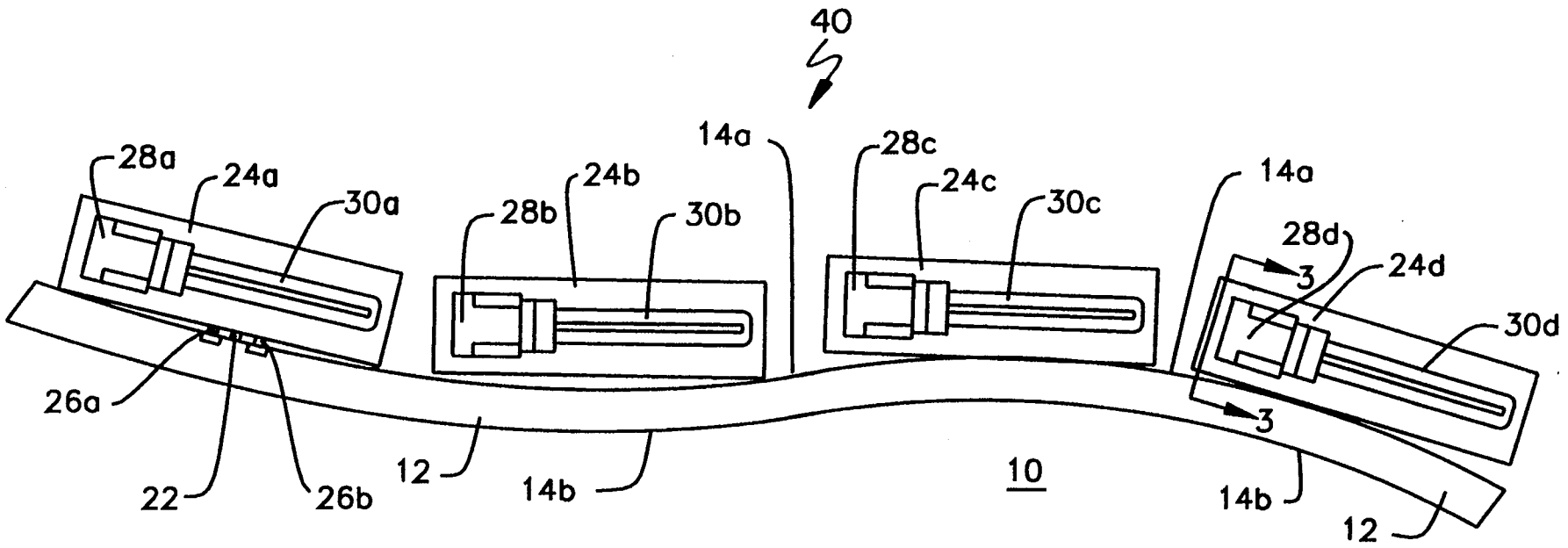
FIG. 2 is a top plan view of the fluorescent lighting fixture of the present invention showing all component parts in detail in a curved shape.
Figure 3B:
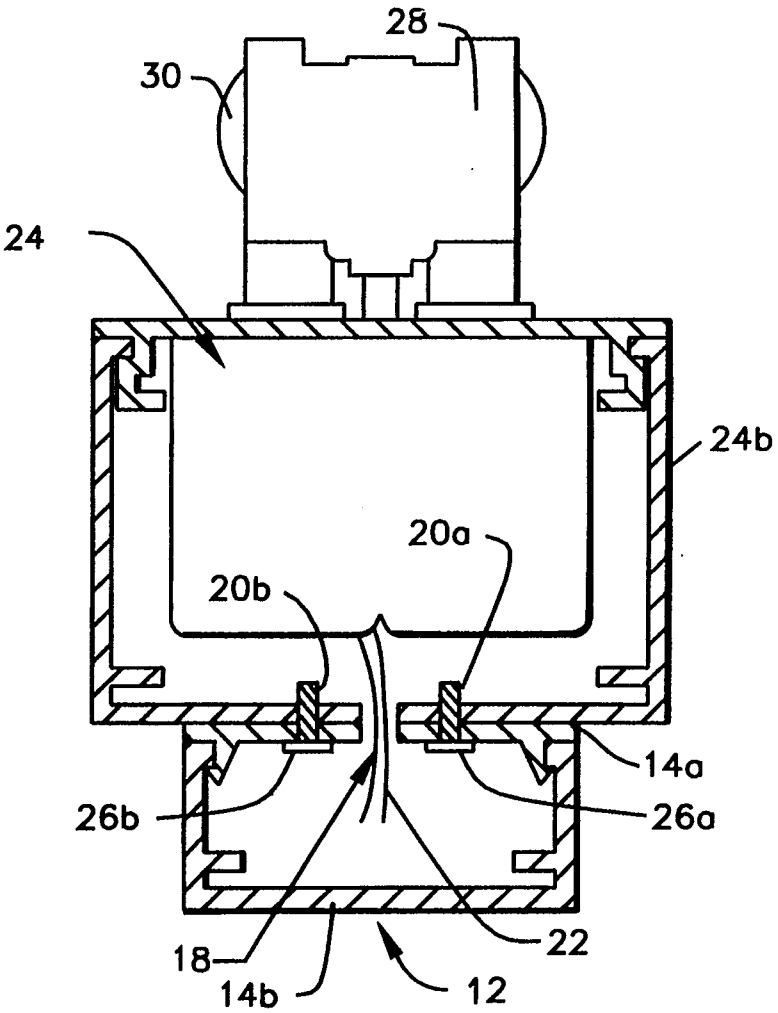
FIGS. 3A and 3B are sectional side views taken along lines 3—3 of FIG. 2 showing the support member, ballast housing, and socket components.
Figure 3A:
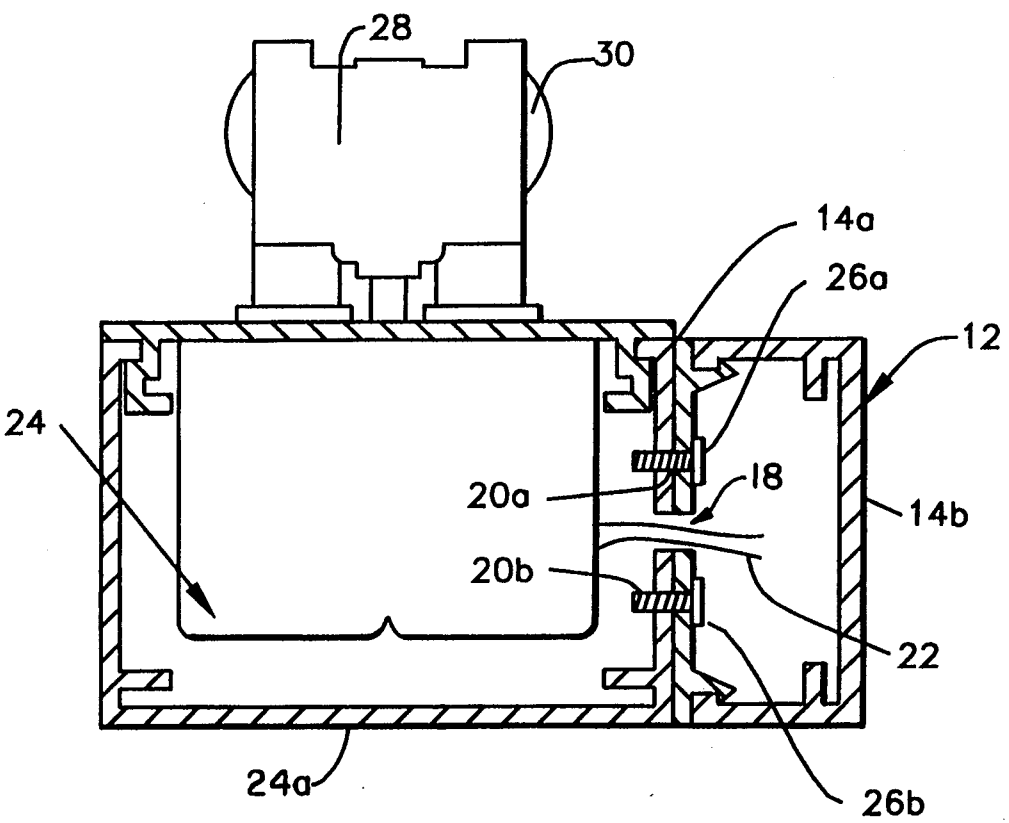

Attached to each ballast housing 24*a* to 24*d* is a lamp socket 28*a* to 28*d*. Attached to each lamp socket 28*a* to 28*d* is a fluorescent lamp 30*a* to 30*d*. The support member 12, the plurality of ballast housings 24*a* to 24*d*, the lamp sockets 28*a* to 28*d*, and the fluorescent lamps 30*a* to 30*d* form the flexible lighting fixture track 40, as depicted in FIG. 2. Ballast housings 24*a* to 24*d* may be attached to either mounting surface 14*a* or 14*b*.

In the preferred embodiment, support member 12 is a rectangular aluminum channel having dimensions which are: $\frac{1}{2}$ inch to $\frac{3}{4}$ inch in thickness, preferably $\frac{5}{8}$ inch, so that it is readily bendable and curvable; and a width of 1 inch to 2 inches, with a preferred width of $1\frac{1}{2}$ inches. The length of lighting track 40 varies, depending on the customer's specifications.

OPERATION OF THE PRESENT INVENTION

The lighting fixture track 40 is shipped to the user in long tubular and/or rectangular-type shipping containers, where the aforementioned track 40 is in a straight modular configuration. The length of the lighting fixture track 40 can be customized to meet the exact length requirements, as specified by the user.

When the lighting track 40 is at the job site, it can be manipulated into any design configuration while in the field without the need of any specially-designed tools. The lighting track 40 will fit the curved contour of a specific project application without the need for exact field dimensions, or the need to have any specially-designed template beforehand.

ADVANTAGES OF THE PRESENT INVENTION

The primary advantage of the present invention is that lighting fixture track 40 has a bendable or adjustable support members 12 which meets all design configuration criteria of any special curved, semi-curved, circular, or radial arc shapes to be placed in any installation, such as a ceiling, contoured cone, wall, or valance.

Another advantage of the present invention is that the lighting fixture track 40 can be curved into shape in the field without special tools, eliminating the need for exact field dimensions and minimizing delivery schedule problems. In using this type of adjustable support members 12, it is the ultimate solution for problems involving "as specified" versus "as built" radius measurements.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A lighting fixture for fluorescent lighting, comprising:

a) a continuous support member formed of curvable material and having a continuous mounting surface;

b) a plurality of spaced-apart ballast housings mounted on said continuous mounting surface;

c) means for connecting said ballast housings to said support member;

d) said support member including an internal passageway for receiving electrical wires to electrically connect said ballast housings;

e) said ballast housings each having one or more socket-receiving surfaces;

f) a socket for receiving a fluorescent lamp mounted on at least one of said socket-receiving surfaces; and g) said continuous support member being curvable to form the lighting fixture into the desired curved shape.

2. A lighting fixture in accordance with claim 1, wherein said curvable material is aluminum, stainless steel, or plastic.

3. A lighting fixture in accordance with claim 1, wherein said continuous support member is a curvable, four-sided and hollow channel member.

4. A lighting fixture in accordance with claim 1, wherein said continuous support member is formed of aluminum and has a width of $\frac{1}{2}$ inch to $\frac{3}{4}$ inch, so that it is bendable.

5. A lighting fixture in accordance with claim 1, wherein said continuous support member has a height of 1 inch to 2 inches.

* * * * *